US009609903B2

(12) United States Patent
Chavez

(10) Patent No.: US 9,609,903 B2
(45) Date of Patent: Apr. 4, 2017

(54) TRANSITION INSOLES

(71) Applicant: Antonio Chavez, Mississauga (CA)

(72) Inventor: Antonio Chavez, Mississauga (CA)

( * ) Notice: Subject to any disclaimer, the term of this patent is extended or adjusted under 35 U.S.C. 154(b) by 0 days.

(21) Appl. No.: 15/147,494

(22) Filed: May 5, 2016

(65) Prior Publication Data

US 2016/0324251 A1 Nov. 10, 2016

Related U.S. Application Data

(60) Provisional application No. 62/158,773, filed on May 8, 2015.

(51) Int. Cl.

| | |
|---|---|
| ***A43B 3/10*** | (2006.01) |
| ***A43B 3/24*** | (2006.01) |
| ***A43B 3/12*** | (2006.01) |
| ***A43B 17/18*** | (2006.01) |
| ***A43B 23/24*** | (2006.01) |
| ***A43B 1/00*** | (2006.01) |

(52) U.S. Cl.

CPC ..... *A43B 3/242* (2013.01); *A43B 1/0027* (2013.01); *A43B 1/0081* (2013.01); *A43B 3/122* (2013.01); *A43B 3/246* (2013.01); *A43B 17/18* (2013.01); *A43B 23/24* (2013.01)

(58) Field of Classification Search

CPC ..... A43B 3/242; A43B 3/244; A43B 3/122; A43B 23/24; A43B 17/18; A43C 11/00

USPC ..... 36/100, 101

See application file for complete search history.

(56) References Cited

U.S. PATENT DOCUMENTS

| | | | | |
|---|---|---|---|---|
| 3,204,346 A * | 9/1965 | Lockard | A43B 3/244 | 36/101 |
| 3,878,626 A * | 4/1975 | Isman | A43B 1/0054 | 36/15 |
| 3,890,725 A * | 6/1975 | Lea | A43B 3/24 | 36/11.5 |
| 4,439,935 A * | 4/1984 | Kelly | A43B 3/128 | 36/100 |
| 4,727,661 A * | 3/1988 | Kuhn | A43B 1/0054 | 36/100 |
| 6,442,870 B1 * | 9/2002 | Tsai | A43B 3/103 | 36/100 |
| 7,908,772 B2 * | 3/2011 | Celia | A43B 1/0045 | 36/100 |
| 2009/0193684 A1 * | 8/2009 | Diamond | A43B 1/0081 | 36/101 |

* cited by examiner

*Primary Examiner* — Jila M Mohandesi

(74) *Attorney, Agent, or Firm* — Nasser Ashgriz; UIPATENT INC.

(57) ABSTRACT

The present invention provides a device used to change the visual appearance of the straps of a shoe. The interchangeable shoe device comprises an insole and a shoe base, wherein the insole is removably secured to the shoe base by one or more fasteners, such as a snap. The shoe base and insole each comprise a toe end opposing a heel end, wherein the heel ends are removably secured to one another so as to allow one or more front straps to be disposed there between.

14 Claims, 13 Drawing Sheets

TRANSITION INSOLES

RELATED APPLICATION

This application claims the benefits of U.S. Provisional Patent Application No. 62/158,773 filed on May 8, 2015.

FIELD OF THE INVENTION

The present invention relates in general to footwear and more particularly to shoes with interchangeable covers.

BACKGROUND OF THE INVENTION

A shoe with interchangeable covers allows one to instantaneously change the look of the shoe. This feature would enable the individual to have numerous pairs of shoes for the price of one. One can match the shoe to a particular outfit using a style or a color that best matches the outfit. Therefore, there would be no need to purchase new pairs of shoes to match different outfits, thus providing significant savings. In addition, shoes occupy precious storage space in closets and the like. Whereas, different covers of an interchangeable shoe can all be stored in a much smaller volume. Storage space becomes more important when packing for a travel. It is difficult to fit several pairs of shoes in a suitcase, yet many travelers, especially business travelers, may need to have several pair of shoes for different events and occasions during their travel. Shoes with interchangeable covers allow the traveler to pack several different colors and styles of a shoe with carrying only one shoe base.

Shoes with interchangeable covers are known in the prior art. Shoes having a removable cover secured to the original shoe by hook and loop fastener have been disclosed. These covers provide a second layer to the shoe and cover the entire shoe and the user's feet would heat up and be uncomfortable.

Another disadvantage of these covers is that they could easily loosen and the cover would disengage from the shoe. Most of the Prior arts propose using a stretchable material for shoe cover. These materials are not a suitable covers. Additionally in some cases adhesive is used to secure the cover on original shoe which could ruin the original shoe.

Another disadvantage of the shoe covers disclosed in prior art is the securement means which are insufficient and the shoe cover could slip off the shoe during the use. In most of the shoe covers disclosed before, the cover changes only the front portion of the shoe leaving the back portion in original color and style.

The present invention discloses a shoe with interchangeable covers in which the front part and back part of the shoe can be easily and securely changed and provide different styles and colors as long as it keeps the original shape of the shoe without any slipping.

SUMMARY OF THE INVENTION

The present invention is an interchangeable shoe with transition insole that comprises of an insole and a shoe base, wherein the insole is removably secured to the shoe base by one or more fasteners, such as a snap or hook and loop fasteners. The shoe base and the insole each comprise of a toe end opposing a heel end, wherein the heel ends are removably secured to one another so as to allow one or more front straps to be disposed there between. The front strap is configured as a loop.

The toe ends of the insole and shoe base are secured together so as to prevent the front strap from detaching from the shoe. The interchangeable shoe further comprises of one or more heel straps adapted to removably secure a user's foot to the device. The heel strap is disposed around the insole and the shoe base, wherein it is removably secured to the bottom surface of the shoe base by one or more fasteners, such as a snap.

In another embodiment of the present invention, the heel strap is secured on the shoe base by a clamp mounted on the shoe base. The clamp allows the heel strap to be disposed there between to hold and secure the heel strap in place and prevent of any movement. The heel strap adapted to removably secure a user's foot to the shoe. The toe end of the insole is secured to the toe end of the shoe base by any suitable fastener, such as stitching.

In operation, the heel end of the insole is separated from the heel end of the shoe base, wherein the front strap is placed there between and positioned towards the toe end of the shoe in order to removably secure a foot thereto. The heel strap is then disposed in the clamp to removably secure the heel strap there in. The heel ends of the insole and shoe base are then secured to one another, whereby the insole of the shoe will completely cover the clamp and the heel strap and provide a comfortable fit.

It is therefore an object of the present invention to provide an interchangeable shoe covers that can be easily and quickly change the appearance of the shoe.

It is another object of the present invention to provide a simple means for quickly and firmly secure an interchangeable member to a shoe with simple and effective elements which do not affect the appearance or comfort of the shoe.

It is another object of the present invention that shoes which do not fit properly can be transformed into shoes that can be worn at any time and for any occasion and are great for those who find it hard to purchase the correct size shoes.

Other objects, features, and advantages of the present invention will be readily appreciated from the following description. The description makes reference to the accompanying drawings, which are provided for illustration of the preferred embodiment. However, such embodiments do not represent the full scope of the present invention.

BRIEF DESCRIPTION OF THE DRAWINGS

Embodiments herein will hereinafter be described in conjunction with the appended drawings provided to illustrate and not to limit the scope of the claims, wherein like designations denote like elements, and in which:

FIG. 3 shows a perspective view of an embodiment of the interchangeable shoe with transition insole with the front strap and heel strap mounted there on;

DETAILED DESCRIPTION OF PREFERRED EMBODIMENTS

Figure 1:
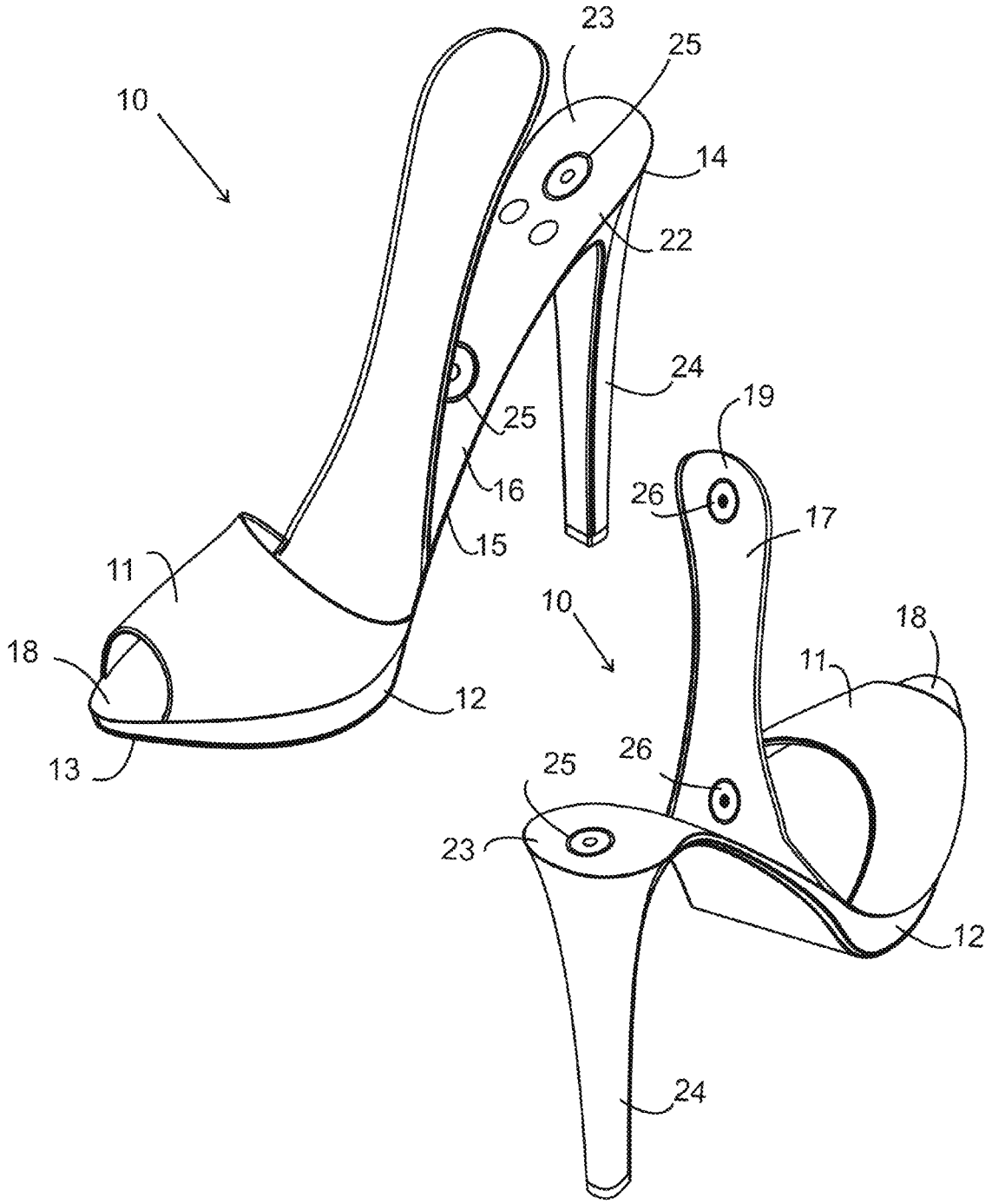
FIG. 1 shows a perspective view of the insole attachment mechanism of the interchangeable shoe with transition insole, wherein the front strap is attached thereon.
Figure 2:
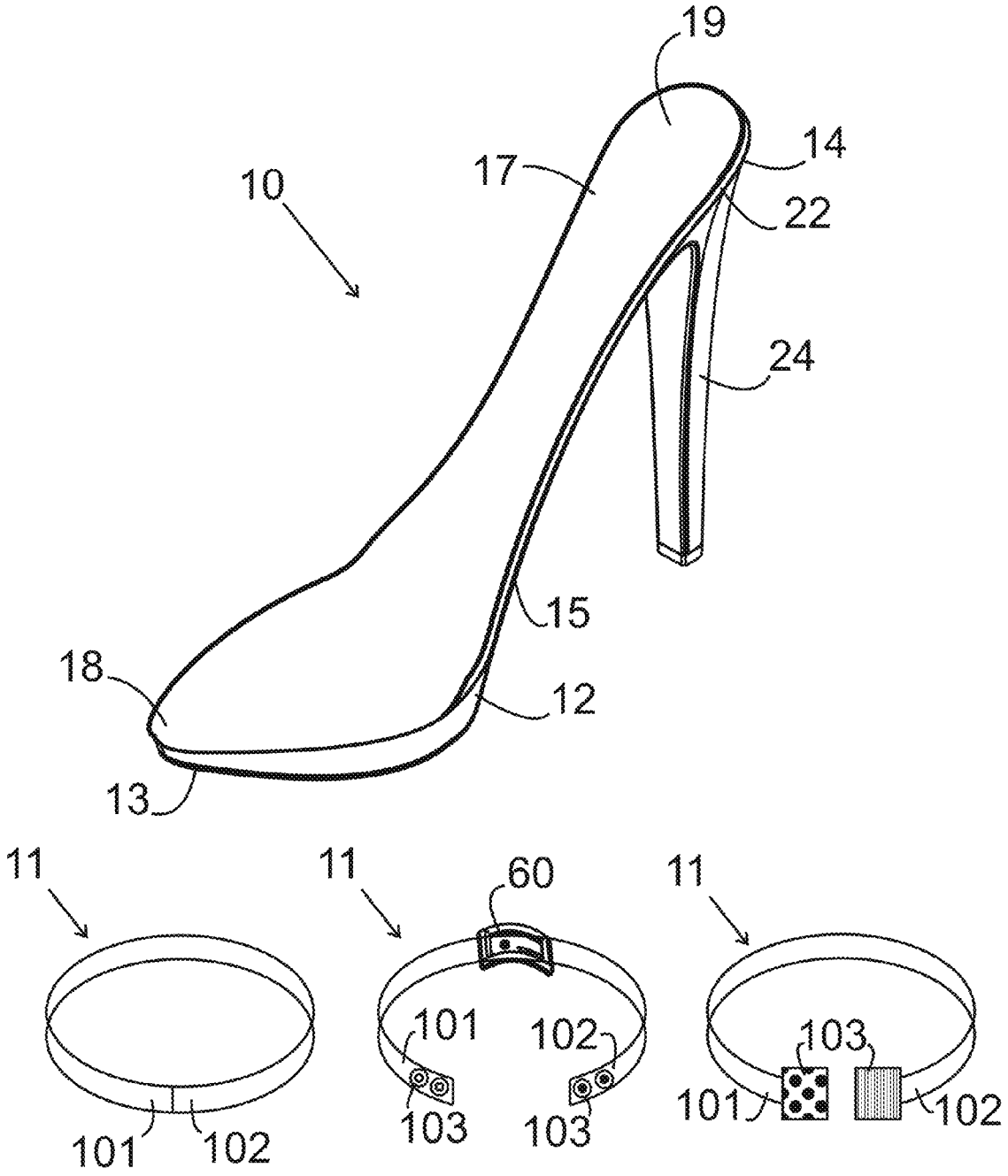
FIG. 2 shows a perspective view of the insole and shoe base of the interchangeable shoe with transition insole, wherein the insole is attached to the shoe base and the detached front strap.
Figure 5:
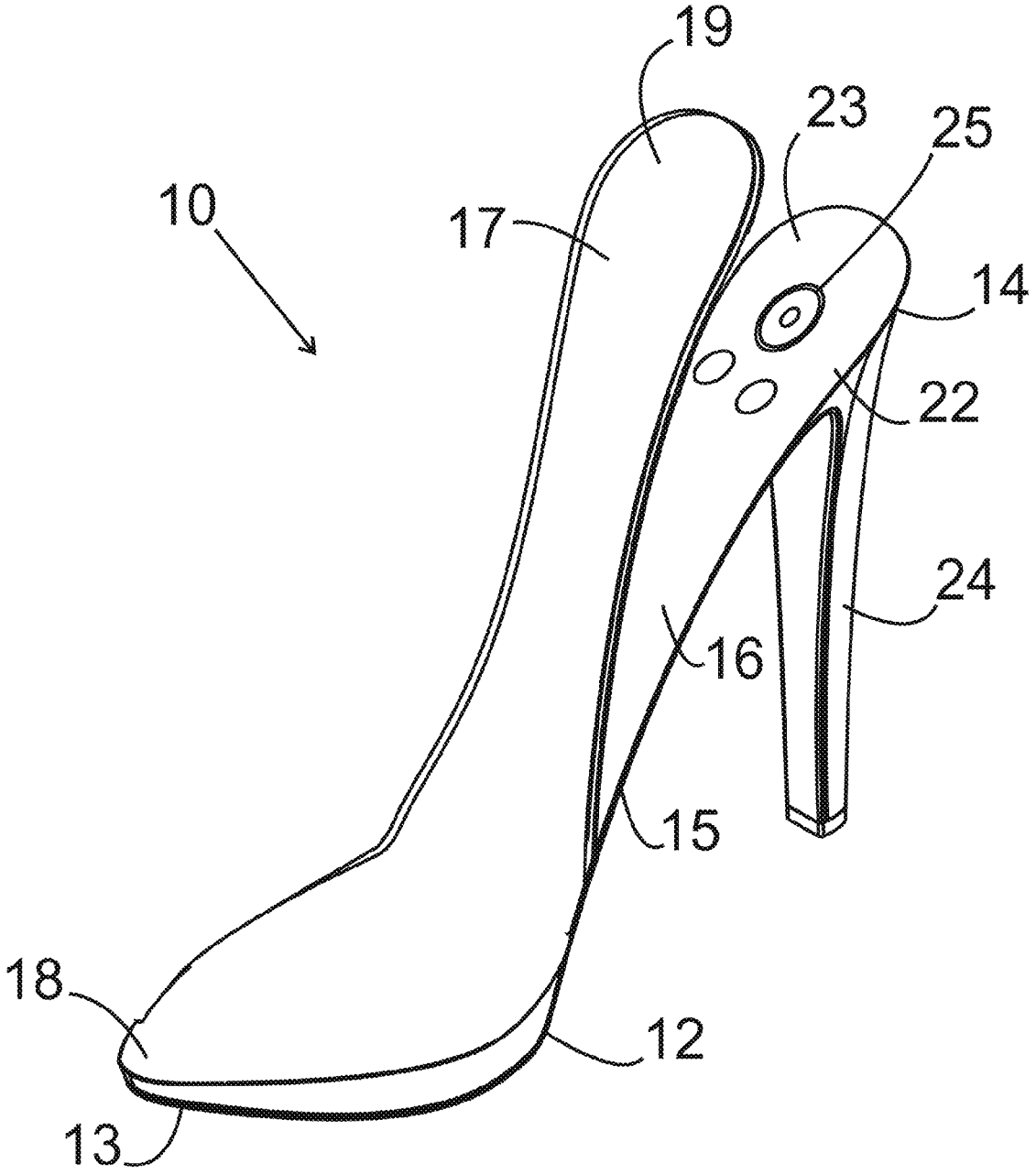
FIG. 5 shows a perspective view of the interchangeable shoe with transition insole without the straps.

FIGS. 1, 2, and 5, show perspective views of the insole attachment mechanism of the interchangeable shoe with transition insole with and without the front strap and a perspective view of the insole and shoe base of the interchangeable shoe. The interchangeable shoe with transition insole 10 comprises of one or more front straps 11 and a shoe base 12 having a toe end 13 opposing a heel end 14 and a bottom surface 15 opposing an upper surface 16. The bottom surface of the shoe base 15 is adapted to engage the surface there below, such as the ground. In the illustrated embodiment, the shoe base 12 comprises of a high heel 24 firmly attached to the bottom surface of the shoe base 15. However, in other embodiments, the heel can be any suitable height, such as a low or a medium height heel. The shoe further comprises of an insole 17 having a toe end 18 and a heel end 19, wherein the heel end of the insole 19 is removably secured to the upper surface of the heel end 23 of the shoe base so as to allow a front strap 11 to be disposed there between. Any suitable fastener 25 can be used to removably secure the heel ends 14 and 19 together, such as a snap, a magnetic snap or hook and loop fasteners (Velcro).

According to FIG. 2 again the front strap 11 is a strap having a distal end 101 and a proximal end 102 fastened together in a manner to make a loop shape strap to perfectly fit in it's place. Said front strap 11 can also have fastening means 103 on distal end 101 and proximal end 102 to be attached to each other or to the fastening means provided on the toe end of the top surface of the shoe base. The front strap 11 further comprising of means to adjust the length of the strap 60. The adjustment can also reached by fastening means 103 provided on the distal end and proximal end of the strap 11. This feature is great for those who find it hard to purchase the correct size shoes and those who have wide toes. Front-strap-fastening means can be any of the snap, magnetic snap or hook and loop fasteners (Velcro).

Referring to FIGS. 1, 2 and 5 again the toe end of the insole 18 is secured to the upper surface of the toe end of the shoe base 13 by any suitable fastener, such as stitching. In this way, the front strap is prevented from detaching from the device via the toe end. In some embodiments, the front strap 11 comprises of a buckle adapted to adjust the length of the strap.

Figure 3:
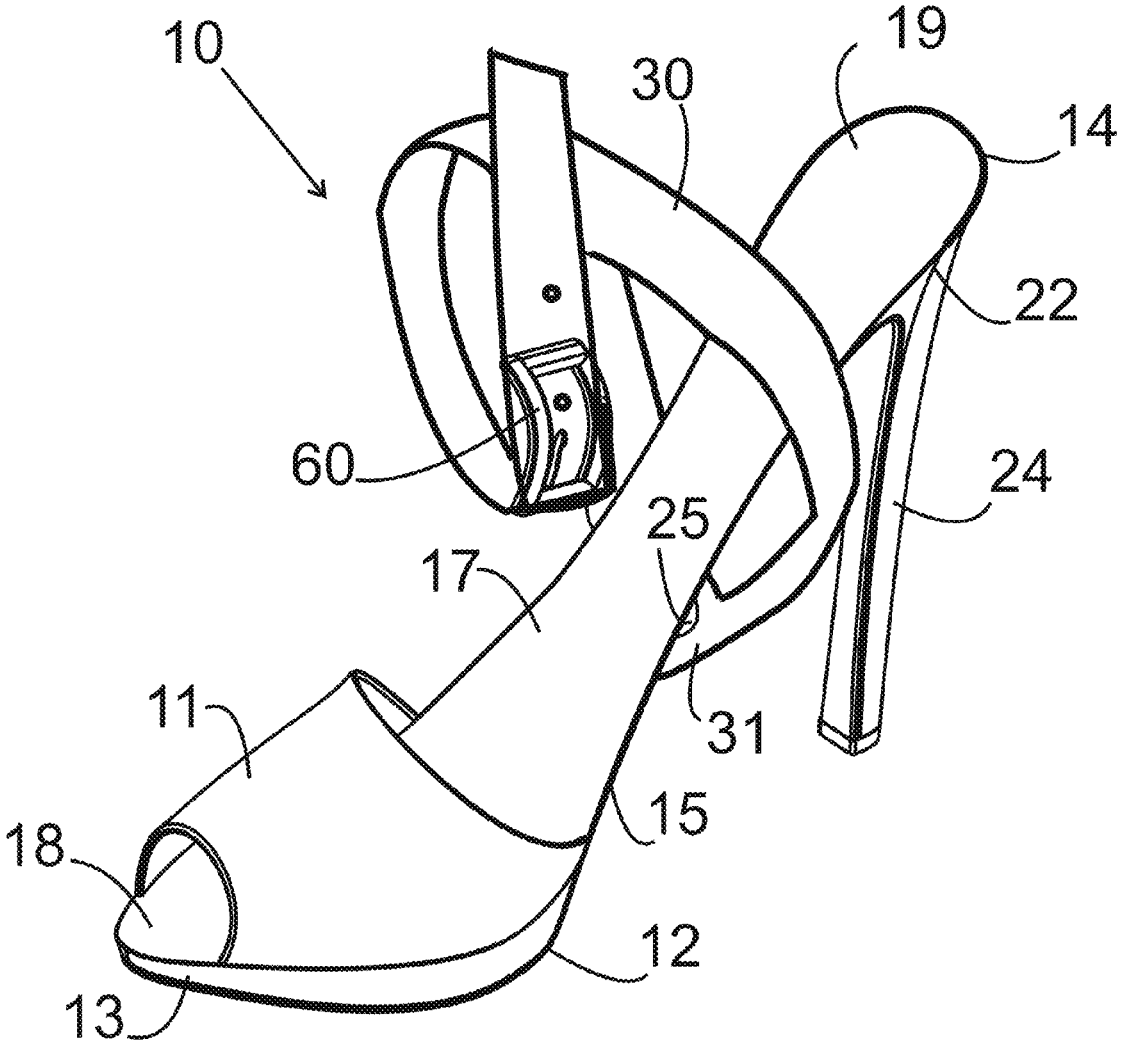
Figure 4:
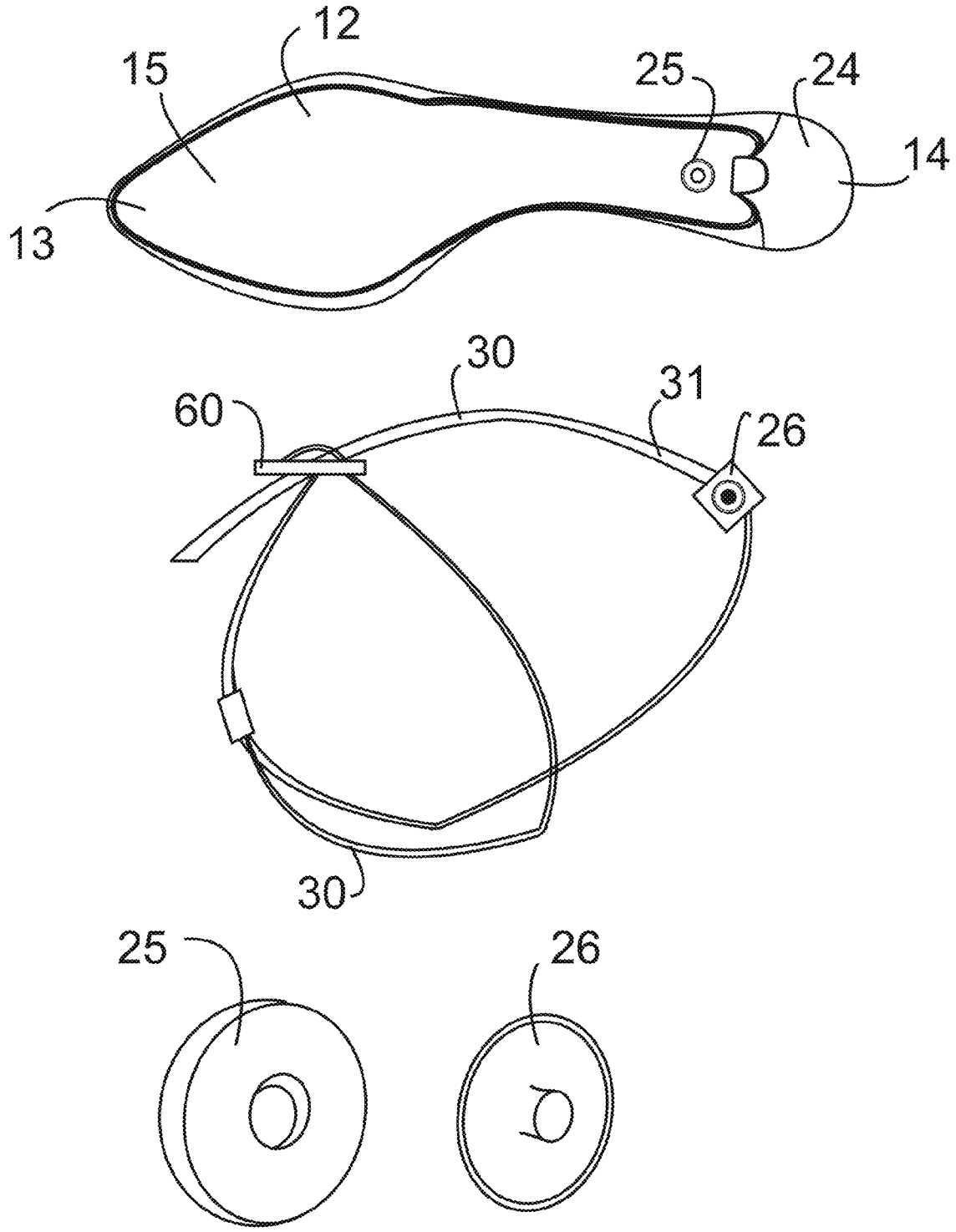
FIG. 4 shows a rear perspective view of the shoe base and heel strap of the interchangeable with transition insole.

As shown in FIGS. 3 and 4, the interchangeable shoe with transition insole 10 further comprises of a heel strap 30 adapted to removably secure a user's foot to the shoe. The heel strap 30 comprises of a left strap and a right strap, wherein one end of said left strap and said right strap on the bottom portion 31 are joined and formed a loop shape heel strap having a fastening means 26 such as a snap to attach to the bottom surface of the shoe base 15. The bottom portion of the heel strap 31 is attached to the bottom surface of the shoe base 15 by male 25 and female 26 parts of a snap or by male 25 and female 26 parts of a magnetic snaps. The heel strap 30 further has a top portion adapted to removably secure a user's foot to the shoe. The heel strap 30 is disposed around the insole 17 and removably secured to the bottom surface of the shoe base 15 by any suitable fastener, such as a snap 25. In some embodiments, the heel strap 30 comprises of a buckle 60 adapted to adjust the length of the strap. The heel straps 30 have a design to fit properly on shoe base and can vary in any style such as open back or closed back. This provides a more elegant look while achieving the function of stabilization and comfort in walk.

In order to install a new strap, the heel end of the insole 19 is separated from the heel end of the shoe base 14, and a front strap 11 is placed there between and positioned towards the toe end of the shoe in order to removably secure a foot thereto. The heel ends of the insole 19 and shoe base 14 are then secured to one another. The heel strap 30 is then disposed around the insole 17 and shoe base 12, wherein it is removably secured to a fastener like a snap 25 disposed on the bottom surface of the shoe base 15.

FIG. 4 is a perspective view of the bottom of the shoe base 15. A snap 25 is mounted on the bottom surface of the shoe base 15. A heel strap 30 of the interchangeable shoe 10 is fastened to the snap 25 on the bottom of the shoe base 15 and adapted to removably secure a user's foot to the shoe. The heel strap 30 is disposed around the insole and the shoe base.

The bottom portion of the heel strap 31 is attached to the bottom surface of the shoe base 15 by male 25 and female 26 parts of a snap or by male 25 and female 26 parts of a magnetic snap.

Figure 6:
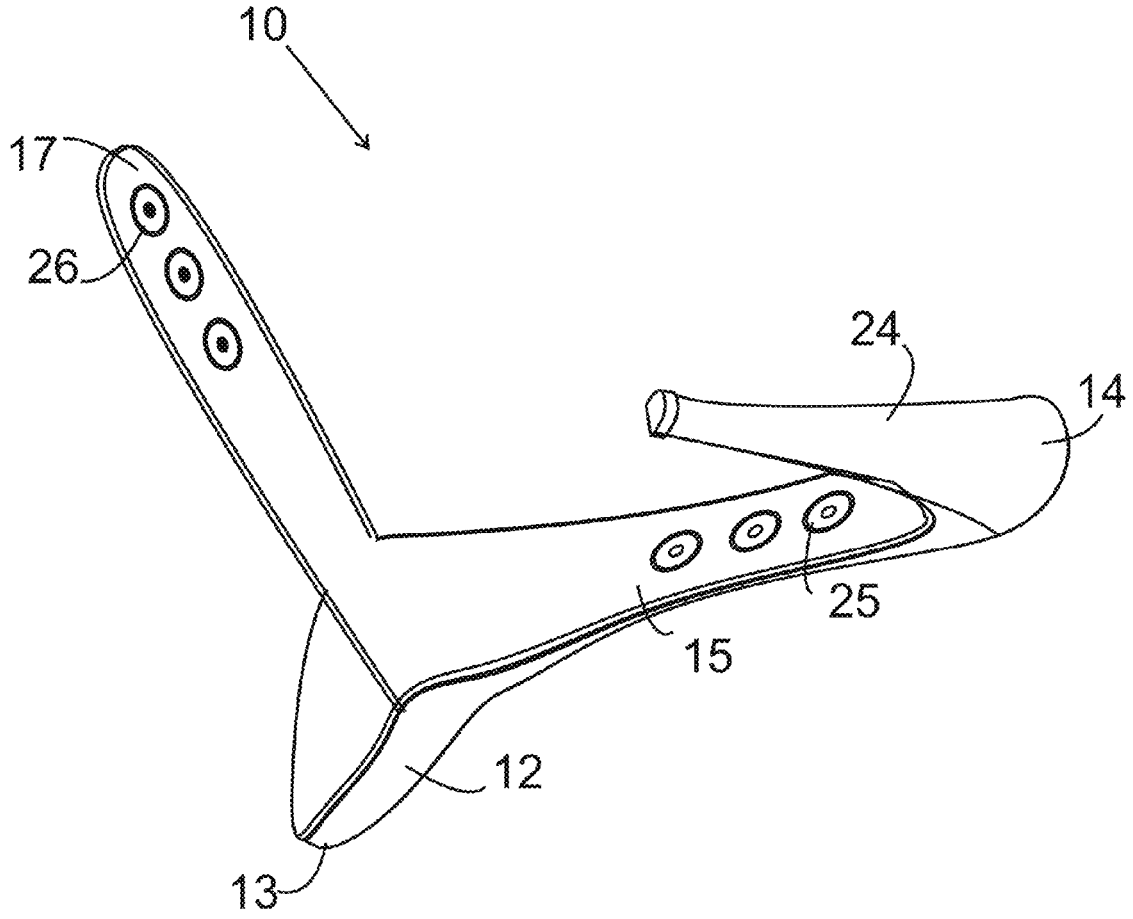
FIG. 6 shows a perspective view of another embodiment of the interchangeable shoe with transition insole.

FIG. 6 shows another embodiment of the transition insole 17 of the interchangeable shoe 10. The shoe comprises of a shoe base 12 and an insole 17, wherein the insole 17 is removably connected to the bottom of the shoe base 15 by fastening means such as snap 25-26, magnetic snap or other suitable fasteners.

Figure 7:
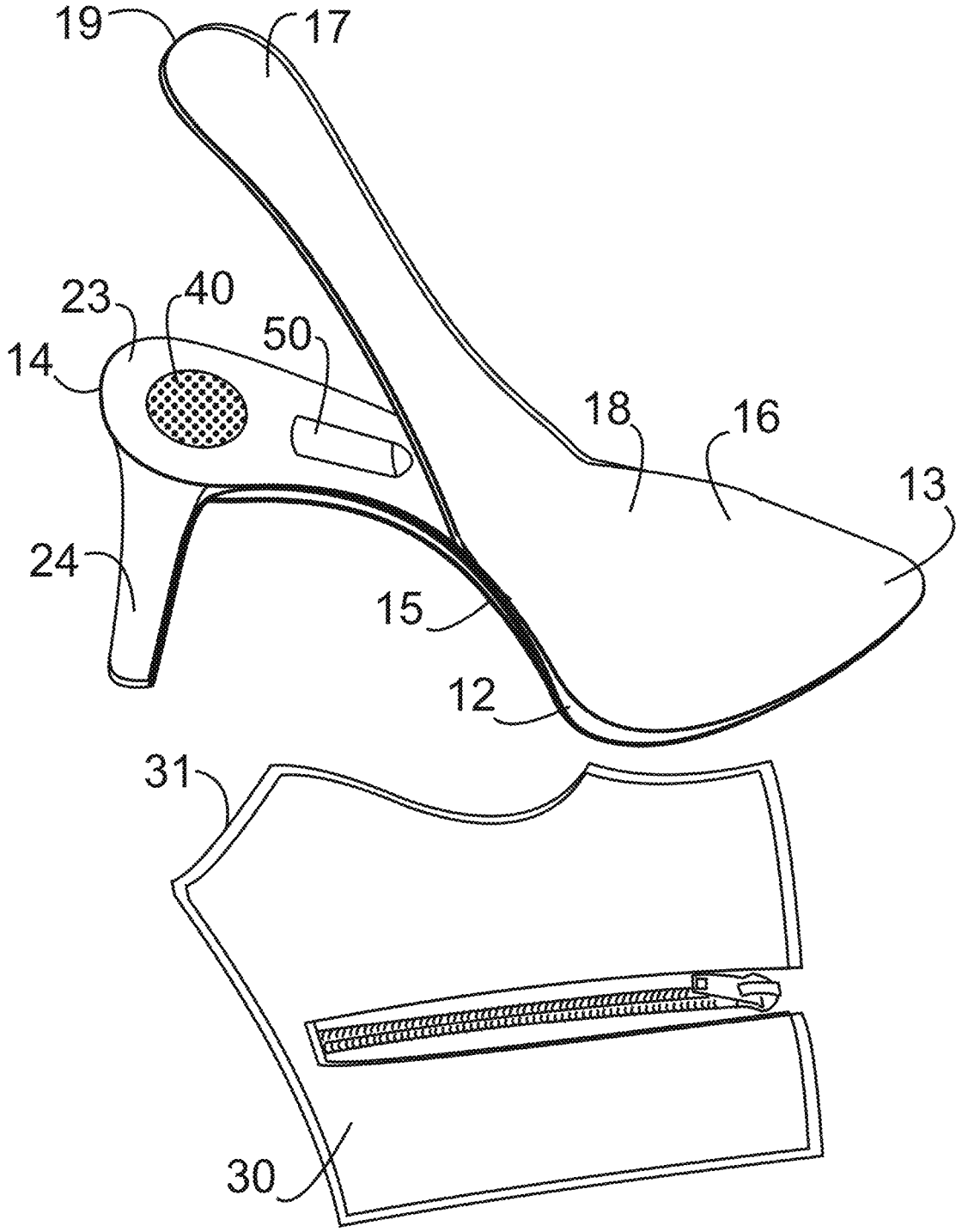
FIG. 7 shows a perspective view of another embodiment of the present invention.
Figure 9:
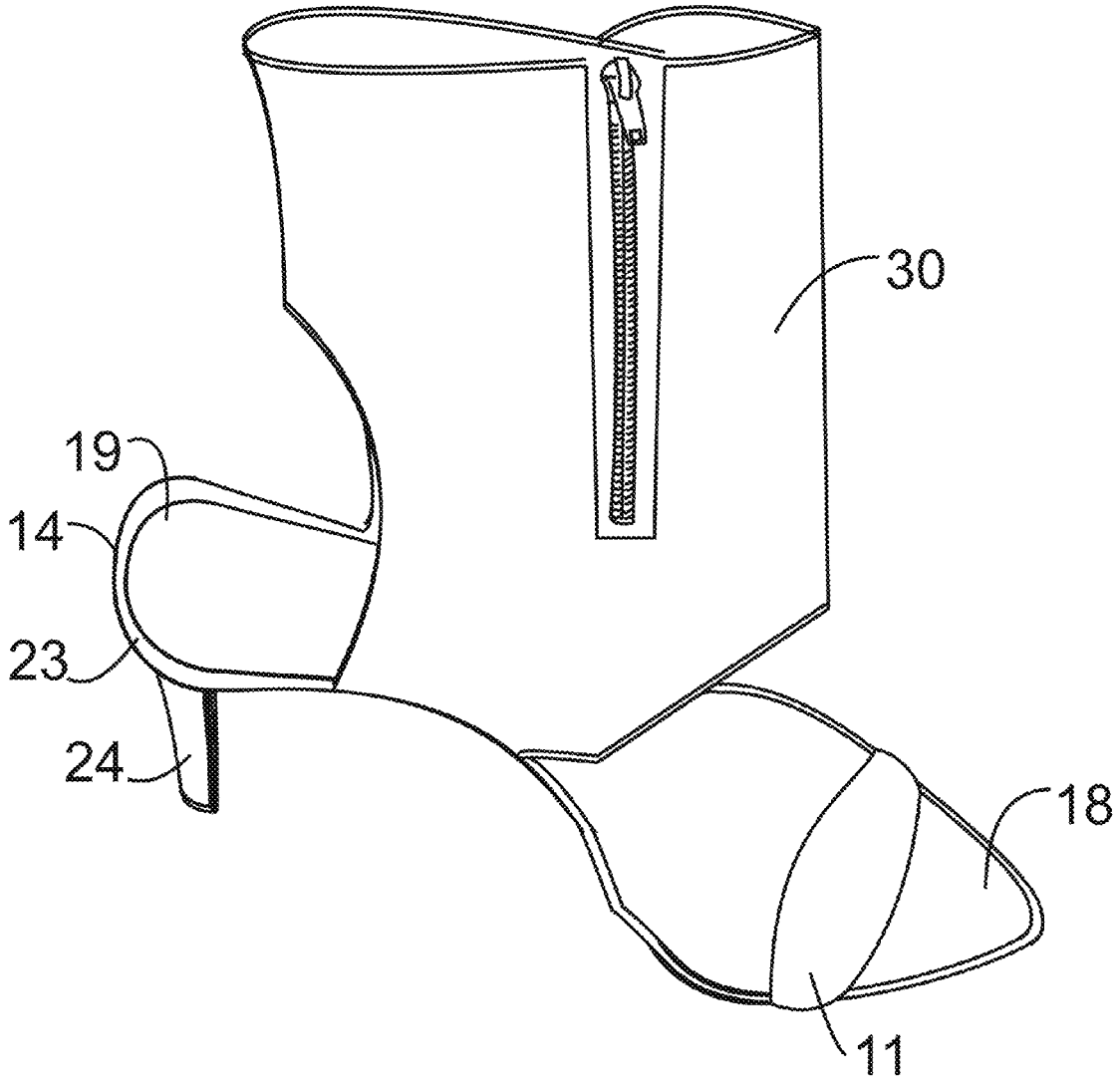
FIG. 9 shows an interchangeable shoe cover assembled on the insole according to an embodiment of the present invention.

FIGS. 7 and 9 show another embodiment of the present invention 10 of the interchangeable shoe cover and its method of assembly. FIG. 7 shows the insole attachment mechanism of the interchangeable shoe with transition insole 10. The interchangeable shoe 10 comprises a shoe base 12 having a toe end 13 opposing a heel end 14 and a bottom surface 15 opposing an upper surface 16. The bottom surface of the shoe base 15 is adapted to engage the surface there below, such as the ground. In the illustrated embodiment, the shoe base 12 comprises a high heel 24 firmly attached to the bottom surface of the shoe base 15. However, in other embodiments, the heel can be any suitable height, such as low or medium height. The shoe further comprises of an insole 17 having a toe end 18 and a heel end 19, wherein the heel end of the insole 19 is removably secured to the upper surface of the heel end 23 of the shoe base. Any suitable fastener, such as a hook and loop fastener can be used to attach two securing areas. A hook 40 on the upper surface of the heel end 23 and a loop 41 on the bottom surface of heel end of the insole 32 are provided to fasten and secure the heel ends 14 and 19 together. It is, understood that the hook and loop positions can be reversed.

Again according to FIG. 7, the interchangeable heel strap 30 features an ankle boot with a zipper on the inner side of the shoe. Said strap 30 have a bottom portion 31 to be disposed on the shoe base 12 by a securing means. Heel straps 30 can be made of different fabrics and in a variety of patterns, colours and styles.

Figure 8:
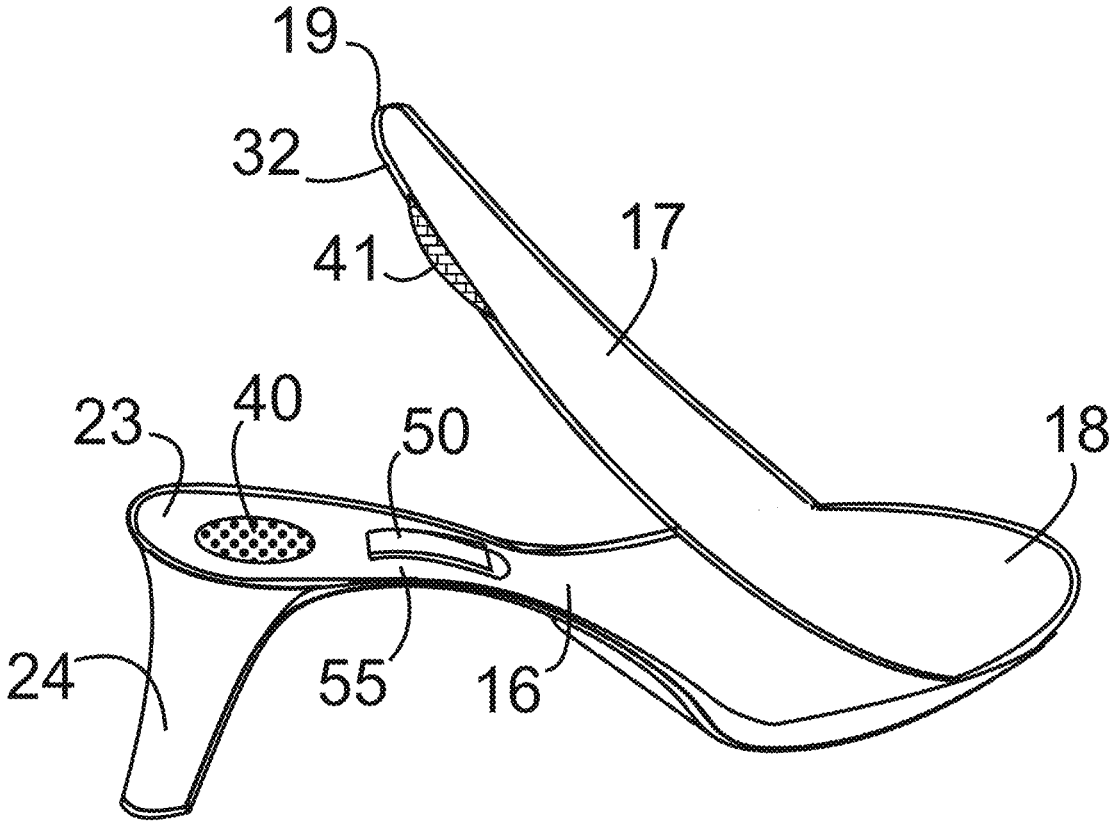
FIG. 8 shows a perspective view of the insole and shoe base according to one embodiment of the present invention.

As shown in FIG. 8, a clamp 50 is mounted on the upper surface of the shoe base 16. Said clamp 50 is mounted on the shoe base 12 in a distance close to the heel end 14 in the arch area 55 of the shoe base. The clamp 50 can be of any material to allow the heel strap 30 to be disposed there between and to be securely held in place, preventing any movement. The heel strap 30 is adapted to removably secure a user's foot to the shoe and have a design to fit properly in the clamp 50. The interchangeable shoe with transition insole 10 further comprises of an insole 17 having a toe end 18 and a heel end 19. A hook 40 and loop 41 fastener on the upper surface of the heel end 23 and the bottom surface of the heel end of the insole 32, respectively, are provided to fasten and secure the heel ends 14 and 19 together.

According to FIG. 9 the heel end of the insole 19 is removably secured to the upper surface of the heel end 23 of the shoe base so as to allow a front strap 11 to be disposed there between. The front strap 11 is configured as a loop. Any suitable fastener can be used to removably secure the heel ends 14 and 19 together. The toe end of the insole 18 is secured to the upper surface of the toe end of the shoe base 21 by any suitable fastener, such as stitching. In this way, the front strap is prevented from detaching from the device via the toe end. In some embodiments, the front strap 11 comprises of a buckle adapted to adjust the length of the strap or comprises of a plurality of straps.

During the assembly, the heel end of the insole 19 is separated from the heel end of the shoe base 14, wherein the front strap 11 is placed there between and positioned towards the toe end of the shoe in order to removably secure a foot thereto. The heel strap 30 is then disposed in the clamp 50 to removably secure the heel strap 30 there in. The heel ends of the insole 19 and shoe base 14 are then secured to one another, thereby the insole of the shoe 17 will completely cover the clamp 50 and bottom portion of the heel strap 31 to provide a comfortable fit. An extra layer of padding can be provided between the shoe base 12 and the insole 17 of the shoe 10. This padding would be similar to standard padding that is inserted into shoes for added comfort. The front strap 11 and the heel strap 30 are configured as a loop.

Figure 10:
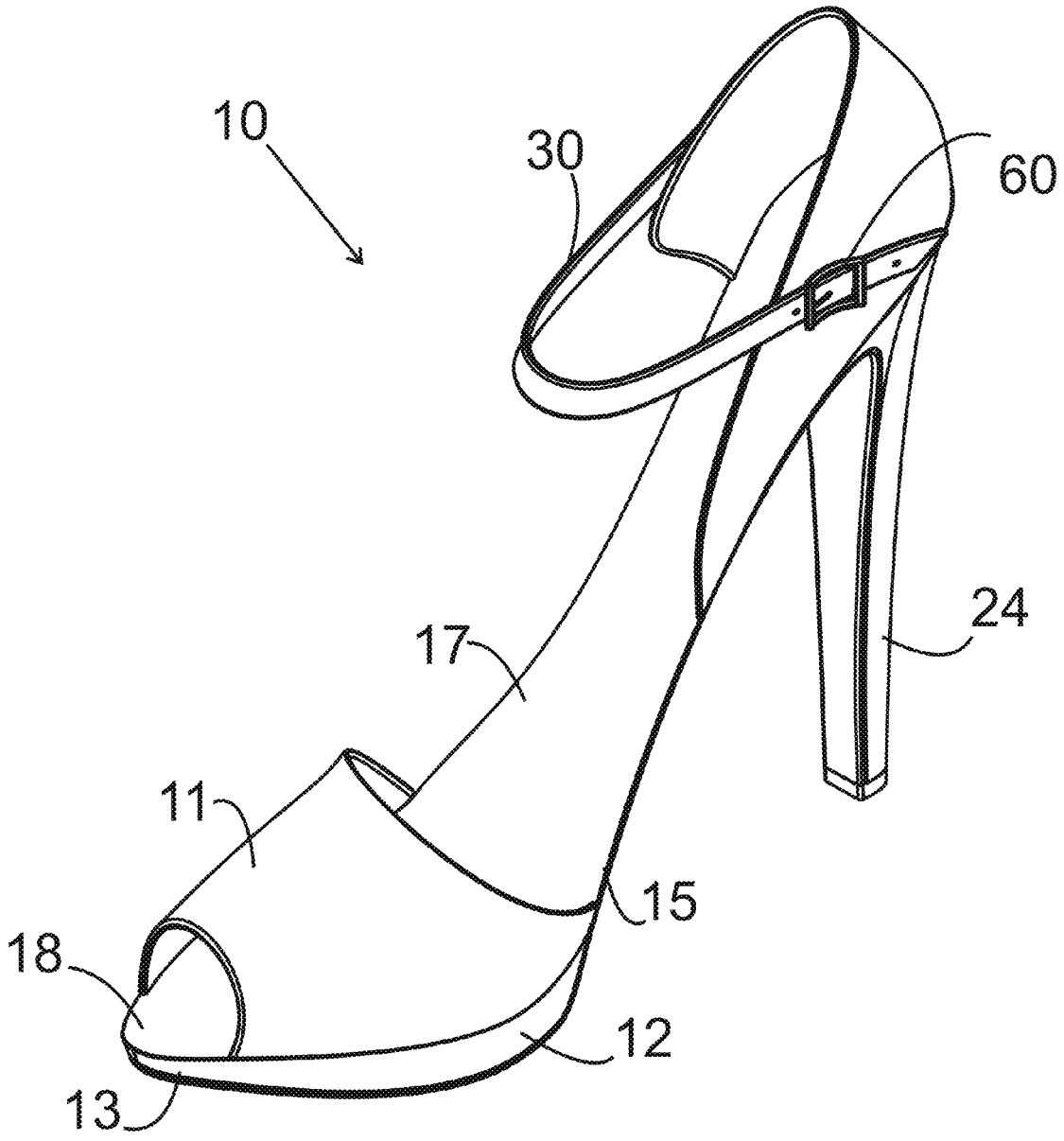
FIG. 10 shows an interchangeable shoe cover assembled on the insole according to another embodiment of the present invention.

FIG. 10 shows a long heel 24 women fashion shoe having interchangeable cover parts according to the embodiments of the present invention. The heel strap 30 features a closed back with a matching front strap 11 and changeable by the user. The heel strap is fastened to the shoe base through a plurality of fastening means according to the present invention. A buckle 60 is adapted to adjust the length of the straps.

Figure 11:
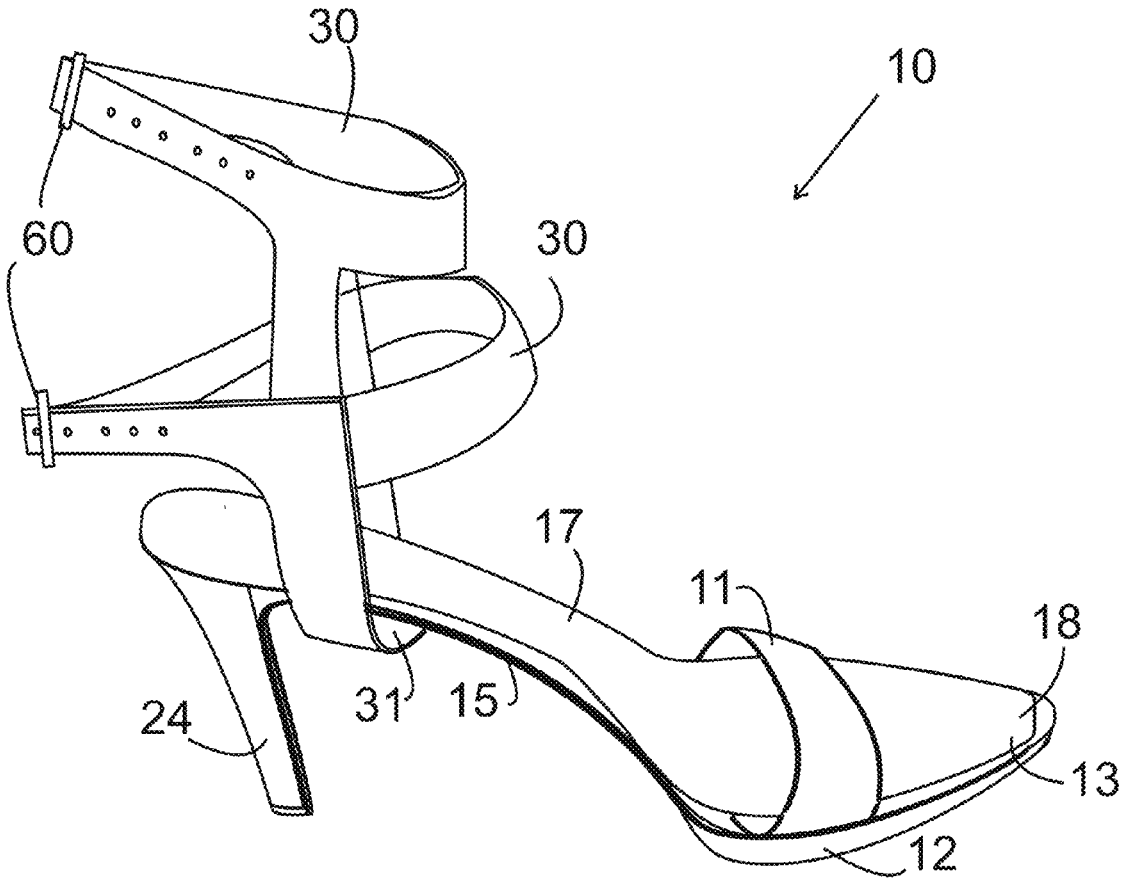
FIG. 11 shows an interchangeable shoe cover assembled on the insole according to another embodiment of the present invention.

FIG. 11 features a long heel open back women fashion shoe having a front strap 11. The shoe features a heel strap 30 comprising of two straps that go around the back of the achilles heel. This provides a more elegant look while still achieving a stabilization function. The bottom portion of the heel straps 31 is fastened to the bottom base 15 through a fastener. The decorative ankle straps 30 are fastened with buckles 60 to the user's ankle.

Figure 12:
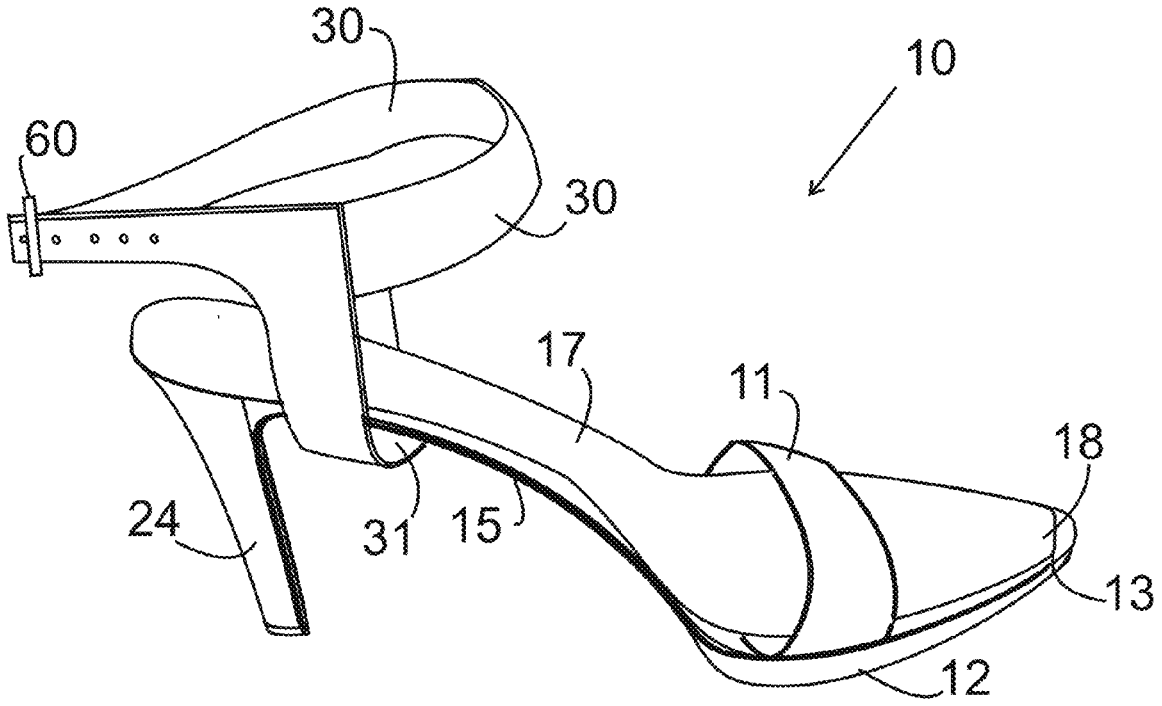
FIG. 12 shows an interchangeable shoe cover assembled on the insole according to another embodiment of the present invention.

FIG. 12 features another long heel open back women fashion shoe having a front strap 11. The shoe features a heel strap 30. The bottom portion of the heel strap 31 is fastened to the bottom base 15 through a fastener. The decorative ankle strap 30 is fastened with a buckle 60 to the user's ankle.

FIGS. 13A, 13B, 13C, 13D, 13E show a plurality designs for the interchangeable shoe 10 according to the embodiments of the present invention. The interchangeable covers can be a plurality of decorative front straps in different colours and styles and a plurality of decorative heel straps in different styles and colours to be able to change and match with each other.

Figure 13A:
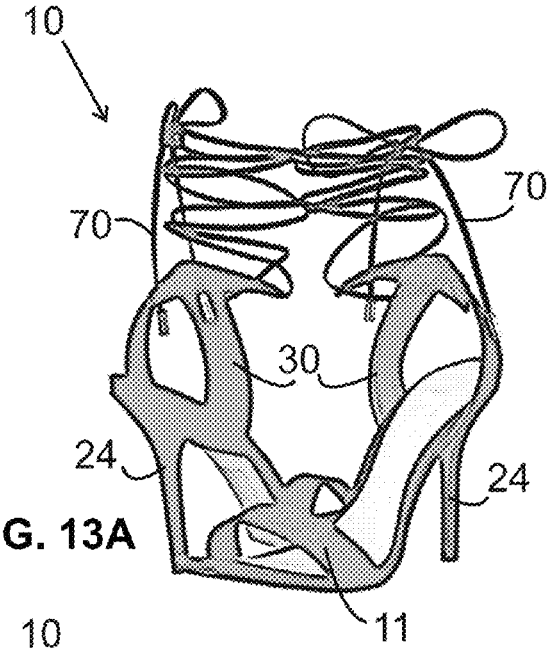
FIG. 13A shows an interchangeable cover for the shoe according to the embodiments of the present invention.

As shown in FIG. 13A, a long heel 24 women fashion shoe having interchangeable cover parts is disclosed according to the embodiments of the present invention. The heel straps 30 feature an open back with decorative long lace up straps 70 to be extended around the user's ankle matching to the front strap and changeable by the user. Lace Up heels can be any height and usually feature a continuous system of laces to secure the heels onto the feet.

Figure 13B:
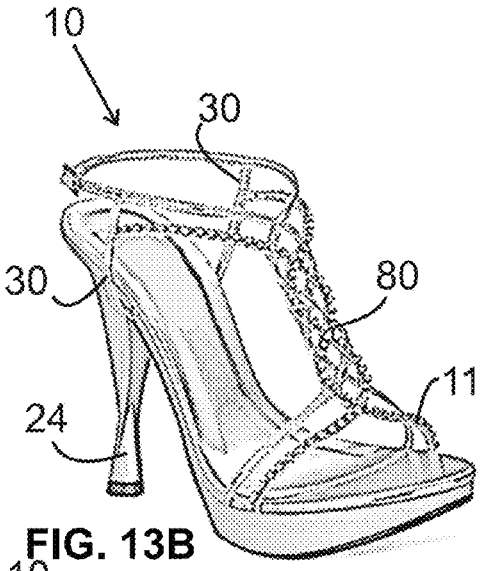
FIG. 13B shows an interchangeable cover for the shoe according to the embodiments of the present invention.

As shown in FIG. 13B the interchangeable shoe cover can feature a tongue 80 at the top centre of the front strap 11. The front strap 11 comprises of two long decorative straps braided together to build a tongue portion 80. The tongue 80 extends toward the heal straps 30 and joins to the heel strap 30 by decorative straps or buckles. It is appreciated that the heel end of the insole 19 is removably secured to the upper surface of the heel end of the shoe base 14 so as to allow the front strap 11 to be disposed there between. The heel straps 30 are configured as two loop straps removably secured to a snap disposed on the bottom surface of the shoe base to receive the straps of the tongue portion 80. A buckle 81 is adapted to adjust the length of the straps. Straps can be criss-cross over the foot or wrap up around the ankle.

Figure 13D:
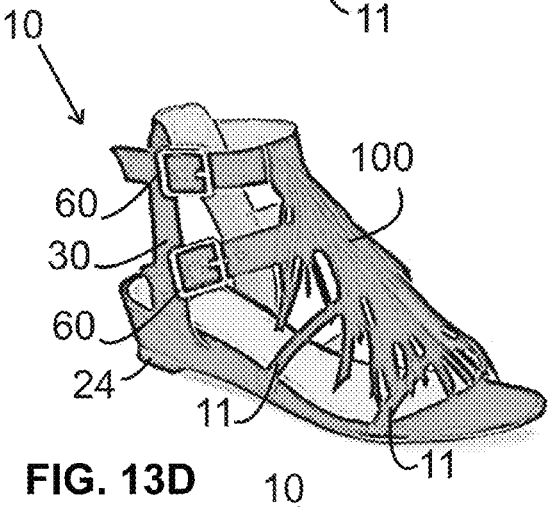
FIG. 13D shows another interchangeable cover for the shoe according to the embodiments of the present invention.
Figure 13C:
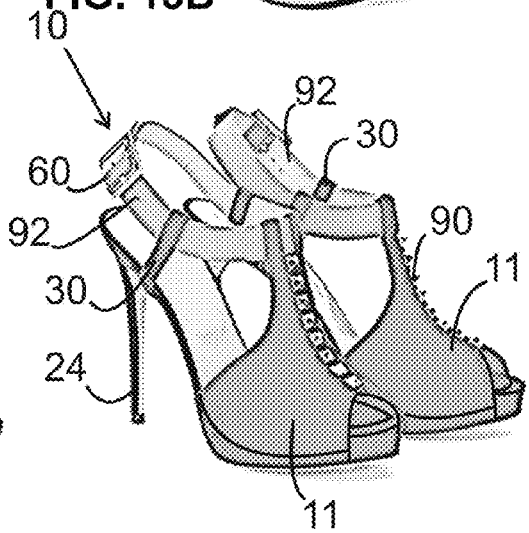
FIG. 13C shows another interchangeable cover for the shoe according to the embodiments of the present invention.

FIG. 13C features a long heel open back women fashion shoe having a front strap 11 with metal decorative buttons. The front strap 11 features a tongue 90 extended to top centre of the ankle having loops at one end. The shoe features a sling back heel just having a strap that goes around the back of the achilles heel. This provides a more elegant look while still achieving the function of stabilization. The heel straps 30 further having loops on one end and fastened to the bottom base through a fastener. A decorative ankle strap 92 is disposed into the loops of the front tongue and the heel straps and fastened with a buckle 60 to the user's ankle.

FIG. 13D is a short heel open back shoe with two decorative front straps 11 and a heel strap 30, wherein said heel strap 30 has buckles 60 to adjust the length of the straps and secure the shoe to the foot of the user. The heel strap 30 further has decorative shredded straps 100 attached to the front of it.

Figure 13E:
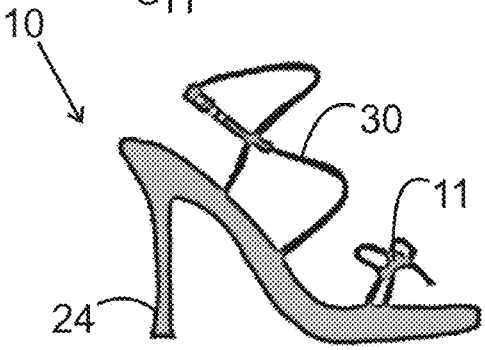
FIG. 13E shows another interchangeable cover for the shoe according to the embodiments of the present invention.

FIG. 13E is a women fashion shoe with an open back and features a single front strap 11 making a decorative bow across the top of the toe area of the shoe. The heel strap 30 of the shoe is formed with a single decorative strap with a buckle to adjust the length.

The shoe with interchangeable covers can be produced of any material and any style in various sizes. Accompanying with various coverings, the shoe base can transform into a wide range of looks and styles. The wearer can easily and quickly change shoe styles by removing the cover, and replacing it with another cover that is secured by fasteners.

While the preferred embodiments of the present shoe with interchangeable covers have been described, it should be obvious that modifications and variations thereto are possible.

The foregoing descriptions of specific embodiments of the present invention have been presented for purposes of illustration and description. They are not intended to be exhaustive or to limit the present invention to the precise forms disclosed, and obviously many modifications and variations are possible in light of the above teaching. The exemplary embodiment was chosen and described in order to best explain the principles of the present invention and its practical application, to thereby enable others skilled in the art to best utilize the present invention and various embodiments with various modifications as are suited to the particular use contemplated.

With respect to the above description, it is to be realized that the optimum relationships for the parts of the invention in regard to size, shape, form, materials, function and manner of operation, assembly and use are deemed readily apparent and obvious to those skilled in the art, and all equivalent relationships to those illustrated in the drawings and described in the specification are intended to be encompassed by the present invention.

What is claimed is:

1. An interchangeable shoe with a transition insole comprising:

a. a shoe-base having a base-toe-end and a base-heel-end, a base-bottom surface, a base-top surface, and an arch area between said base-toe-end and base-heel-end;

b. an insole having an insole-toe-end, a insole-heel-end, an insole-top surface, and an insole-bottom surface, wherein said insole-toe-end is permanently attached to said base-top surface, and wherein the insole-heel-end is adapted to removably attach to said base-top surface;

c. a closed loop front-strap having a strap-top portion, a strap-bottom portion and a front-strap-length, wherein said strap-bottom portion is placed in between said shoe-base and said insole, whereby a user's foot is placed in between the strap-top portion and the insole;

d. an insole-attaching means to attach said insole-bottom surface to said base-top surface, whereby said front-strap is replaced by lifting the insole from the insole-heel-end.

2. The interchangeable shoe with a transition insole of claim 1, wherein said insole-attaching means being selected from the groups consisting of being a snap, a magnetic closure, a magnetic snap, and a hook and loop fastener.

3. The interchangeable shoe with a transition insole of claim 1, wherein said closed loop front-strap further having means to adjust said closed loop front-strap-length.

4. The interchangeable shoe with a transition insole of claim 1, wherein said closed loop front-strap further having a snap or a magnetic closure or a magnetic snap or a hook and loop fastener to further secure the closed loop front-strap in between of said insole-bottom surface and said base-top surface.

5. The interchangeable shoe with a transition insole of claim 1, wherein said closed-loop front-strap is selected from the groups consisting of a decorative lace up strap, a decorative strap with buckles, a strap with decorative buttons, a zipper strap, a bow strap, a tongue strap.

6. An interchangeable shoe with a transition insole comprising:

a. a shoe-base having a base-toe-end and a base-heel-end, a base-bottom surface, a base-top surface, and an arch area between said base-toe-end and base-heel-end;

b. an insole having an insole-toe-end, a insole-heel-end, an insole-top surface, and an insole-bottom surface, wherein said insole-toe-end is permanently attached to said base-top surface, and wherein the insole-heel-end is adapted to removably attach to said base-top surface;

c. a closed-loop front-strap having a strap-top portion, a strap-bottom portion and a strap-length, wherein said strap-bottom portion is placed in between said shoe-base and said insole, whereby a user's foot is placed in between the strap-top portion and the insole;

d. a closed-loop heel-strap having a heel-strap-top portion, a heel-strap-bottom portion and a heel-strap-length, wherein said heel-bottom portion is engaged with said shoe-base with a base-bottom attaching means;

e. an insole-attaching means to attach said insole-bottom surface to said base-top surface, whereby said front-strap is replaced by lifting the insole from the insole-heel-end and said heel-strap is replaced by one another from the base-bottom surface.

7. The interchangeable shoe with a transition insole of claim 6, wherein said insole-attaching means being selected from the groups consisting of being a snap, a magnetic closure, a magnetic snap, and a hook and loop fastener.

8. The interchangeable shoe with a transition insole of claim 7, wherein said closed-loop front-strap further having means to adjust said strap-length.

9. The interchangeable shoe with a transition insole of claim 7, wherein said base-bottom attaching means being selected from the groups consisting of being a snap, a magnetic closure, a magnetic snap, and a hook and loop fastener.

10. The interchangeable shoe with a transition insole of claim 7, wherein said closed-loop heel-strap further having means to adjust said heel-strap-length.

11. The interchangeable shoe with a transition insole of claim 7, wherein said closed-loop front-strap further having a secure-front means to be secured in between of said insole-bottom surface and said base-top surface.

12. The interchangeable shoe with a transition insole of claim 11, wherein said secure-front means being selected from the groups consisting of a snap, a magnetic closure, a magnetic snap, and a hook and loop fastener.

13. The interchangeable shoe with a transition insole of claim 7, wherein said closed-loop heel-strap is selected from the groups consisting of a decorative long lace up strap, a decorative strap with buckles, a strap with decorative buttons, a decorative ankle strap, a zipper strap, a bow strap, a tongue strap.

14. The interchangeable shoe with a transition insole of claim 7, wherein said interchangeable shoe further having a clamp mounted on said base-top surface to be engaged with said closed-loop heel-strap.

* * * * *